US009799285B2

(12) United States Patent
Jang et al.

(10) Patent No.: US 9,799,285 B2
(45) Date of Patent: Oct. 24, 2017

(54) DISPLAY APPARATUS AND METHOD OF DRIVING THE SAME

(71) Applicant: Samsung Display Co., Ltd., Yongin, Gyeonggi-Do (KR)

(72) Inventors: Ji-Eun Jang, Cheonan-si (KR); Seung-Hwan Moon, Asan-si (KR); Sung-In Kang, Hwaseong-si (KR); Kyun-Ho Kim, Cheonan-si (KR); Min-Ho Park, Gwangmyeong-si (KR); Shim-Ho Yi, Seoul (KR); Go-Eun Cha, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 56 days.

(21) Appl. No.: 14/724,192

(22) Filed: May 28, 2015

(65) Prior Publication Data

US 2016/0155373 A1 Jun. 2, 2016

(30) Foreign Application Priority Data

Nov. 27, 2014 (KR) ..... 10-2014-0167613

(51) Int. Cl.
*G09G 5/10* (2006.01)
*G09G 3/36* (2006.01)
*G09G 3/34* (2006.01)

(52) U.S. Cl.
CPC ..... *G09G 3/3648* (2013.01); *G09G 3/3406* (2013.01); *G09G 3/3614* (2013.01);
(Continued)

(58) Field of Classification Search
CPC ..... G09G 3/3648; G09G 2320/0219; G09G 2320/0242; G09G 2320/0285;
(Continued)

(56) References Cited

U.S. PATENT DOCUMENTS

2008/0309602 A1* 12/2008 Hwang ..... G09G 3/006 345/89
2009/0002400 A1* 1/2009 Ha ..... G09G 3/3406 345/690
2011/0096101 A1* 4/2011 Lee ..... G09G 3/3406 345/690

FOREIGN PATENT DOCUMENTS

JP 2008145916 A 6/2008
KR 1020070076078 A 7/2007
(Continued)

OTHER PUBLICATIONS

Kim, Seong il, Analysis on the waterfall phenomenon in LCD and a method of improvement by synchronizing the driving frequencies, Creative Commons Commons Deed, Department of Semiconductor and Display Engineering, pp. 1-54.

*Primary Examiner* — Nicholas Lee
*Assistant Examiner* — Ngan T Pham Lu
(74) *Attorney, Agent, or Firm* — Cantor Colburn LLP

(57) ABSTRACT

A display apparatus includes a display panel which displays an image, a compensation area determiner which divides a display area of the display panel into a compensation area and a normal area, a compensation coefficient determiner which determines a compensation coefficient corresponding to input data of the compensation area, a compensation look up table which stores a noise compensation data which compensates a luminance difference of the compensation area by an interference noise of a light-source driving signal, and a correction data calculator which calculates a correction data corresponding to the input data of the compensation area using the compensation coefficient and the noise compensation data.

20 Claims, 7 Drawing Sheets

(52) U.S. Cl.
CPC ..... *G09G 2320/0219* (2013.01); *G09G 2320/0242* (2013.01); *G09G 2320/0285* (2013.01); *G09G 2320/0673* (2013.01); *G09G 2360/16* (2013.01)

(58) Field of Classification Search
CPC ..... G09G 2320/0673; G09G 2360/16; G09G 3/3406; G09G 3/3614
USPC ..... 345/691
See application file for complete search history.

(56) References Cited

FOREIGN PATENT DOCUMENTS

| | | | |
|---|---|---|---|
| KR | 1020090109767 | A | 10/2009 |
| KR | 1020100075074 | A | 7/2010 |

* cited by examiner

FIG. 3A

313

| GRAY | R | G | B |
|---|---|---|---|
| 1 | NOISE COMPENSATION | NOISE COMPENSATION | NOISE COMPENSATION |
| 2 | | | |
| 3 | | | |
| ⋮ | | | |
| 254 | | | |
| 255 | | | |

FIG. 3B

314

| GRAY | R | G | B |
|---|---|---|---|
| 1 | NORMAL COMPENSATION | NORMAL COMPENSATION | NORMAL COMPENSATION |
| 2 | | | |
| 3 | | | |
| ⋮ | | | |
| 254 | | | |
| 255 | | | |

DISPLAY APPARATUS AND METHOD OF DRIVING THE SAME

This application claims priority to Korean Patent Application No. 10-2014-0167613 filed on Nov. 27, 2014, and all the benefits accruing therefrom under 35 U.S.C. §119, which is hereby incorporated by reference.

BACKGROUND

1. Field

Exemplary embodiments of the invention relate to a display apparatus and a method of driving the display apparatus. More particularly, exemplary embodiments of the invention relate to a display apparatus for improving a display quality and a method of driving the display apparatus.

2. Description of the Related Art

Generally, a liquid crystal display ("LCD") apparatus has a relatively small thickness, low weight and low power consumption. Thus the LCD apparatus is used in various electronic devices such as monitors, laptop computers and cellular phones, etc. The LCD apparatus includes an LCD panel displaying images using a selectively changeable light transmittance characteristic of a liquid crystal while a backlight assembly disposed under the LCD panel provides light to the LCD panel. A driving circuit drives the LCD panel and thereby causes the selective changes of the light transmittance characteristic of the liquid crystals.

The LCD panel includes an array substrate which has a plurality of gate lines, a plurality of data lines crossing the plurality of gate lines, a plurality of thin film transistors and corresponding pixel electrodes. The LCD panel also includes an opposing substrate which has a common electrode.

The backlight assembly provides the LCD panel with a light. The backlight assembly includes a plurality of light-emitting diodes ("LEDs"). The backlight assembly turns on or off the plurality of LEDs based on a light driving signal.

The driver circuit includes a gate driver driving the plurality of gate lines and a data driver driving the plurality of data lines. The gate driver and the data driver drive the LCD panel with a frame frequency.

SUMMARY

Exemplary embodiments of the invention provide a display apparatus for improving a display quality.

Exemplary embodiments of the invention provide a method of driving the display apparatus.

According to an exemplary embodiment of the invention, there is provided a display apparatus. The display apparatus includes a display panel configured to display an image, a compensation area determiner configured to divide a display area of the display panel into a compensation area and a normal area, a compensation coefficient determiner configured to determine a compensation coefficient corresponding to input data of the compensation area, a compensation look up table ("LUT") configured to store a noise compensation data which compensates a luminance difference of the compensation area by an interference noise of a light-source driving signal, and a correction data calculator configured to calculate a correction data corresponding to the input data of the compensation area using the compensation coefficient and the noise compensation data.

In an exemplary embodiment, the compensation area may be divided into a boundary area adjacent to a boundary between the compensation area and the normal area and a remaining area except for the boundary area, and the compensation coefficient determiner may be configured to determine a compensation coefficient of the boundary area to gradually increase by a horizontal line.

In an exemplary embodiment, the display apparatus may further include a normal LUT configured to store a normal compensation data which compensates the input data of the normal area.

In an exemplary embodiment, the noise compensation data of the compensation LUT may have a grayscale being higher than the normal compensation data of the normal LUT with respect to the input data having a same grayscale.

In an exemplary embodiment, each of the compensation LUT and the normal LUT may include red compensation data, green compensation data and blue compensation data respectively corresponding to red, green, and blue input data.

In an exemplary embodiment, the compensation area determiner may be configured to determine the compensation area and the normal area based on a high level and a low level of the light-source driving signal.

In an exemplary embodiment, when a light-source driving frequency of a light-source synch signal is equal to a frame frequency driving the display panel, the compensation area and the normal area may be identically determined by a frame, and when the light-source driving frequency is different from the frame frequency, the compensation area and the normal area may be differently determined by the frame.

In an exemplary embodiment, the display apparatus may further include a delay compensator configured to delay a light-source synch signal based on an input timing of the input data and an output timing of the correction data.

In an exemplary embodiment, the display apparatus may further include a light-source unit comprising at least one light-source which is configured to provide the display panel with a light, and a light-source driver configured to output the light-source driving signal which drives the light-source unit based on the light-source synch signal.

In an exemplary embodiment, the at least one light-source may be a light-emitting diode, and the light-source driving signal may be a pulse width modulation signal.

According to an exemplary embodiment of the invention, there is provided a method of driving the display apparatus. The method includes dividing a display area of a display panel into a compensation area and a normal area, determining a compensation coefficient corresponding to input data of the compensation area, and calculating a correction data corresponding to the input data of the compensation area using the compensation coefficient and noise compensation data, the noise compensation data compensating a luminance difference of the compensation area by an interference noise of a light-source driving signal.

In an exemplary embodiment, the compensation area may be divided into a boundary area adjacent to a boundary between the compensation area and the normal area and a remaining area except for the boundary area, and a compensation coefficient of the boundary area may be determined to gradually increase by a horizontal line.

In an exemplary embodiment, the method may further include compensating input data of the normal area using normal compensation data.

In an exemplary embodiment, the noise compensation data have a grayscale higher than the normal compensation data with respect to the input data having a same grayscale.

In an exemplary embodiment, each of the noise compensation data and the normal compensation data may include red compensation data, green compensation data and blue compensation data respectively corresponding to red, green, and blue input data.

In an exemplary embodiment, the compensation area and the normal area may be determined based on a high level and a low level of the light-source driving signal.

In an exemplary embodiment, when a light-source driving frequency of a light-source synch signal is equal to a frame frequency driving the display panel, the compensation area and the normal area may be identically determined by a frame, and when the light-source driving frequency is different from the frame frequency, the compensation area and the normal area may be differently determined by the frame.

In an exemplary embodiment, the method may further include delaying a light-source synch signal based on an input timing of the input data and an output timing of the correction data.

In an exemplary embodiment, the method may further include driving light-source which provides the display panel with a light based on the delayed light-source driving signal.

In an exemplary embodiment, the light-source may be a light-emitting diode, and the light-source driving signal may be a pulse width modulation signal.

Typically, an interference noise occurs by a driving frequency of the light driving signal and the frame frequency of a driving signal driving the LCD panel. A display defect such as a waterfall noise occurs by the interference noise. However, according to the invention, the input data of the compensation area in which the pixel charge voltage is changed by the interference noise of the light-source driving frequency are compensated, and thus the luminance difference may be decreased or eliminated.

BRIEF DESCRIPTION OF THE DRAWINGS

The above and other features and advantages of the invention will become more apparent by describing in detailed exemplary embodiments thereof with reference to the accompanying drawings, in which:

FIGS. 3A and 3B are conceptual diagrams illustrating a compensation LUT and a normal LUT of FIG. 2;

DETAILED DESCRIPTION

Figure 1:
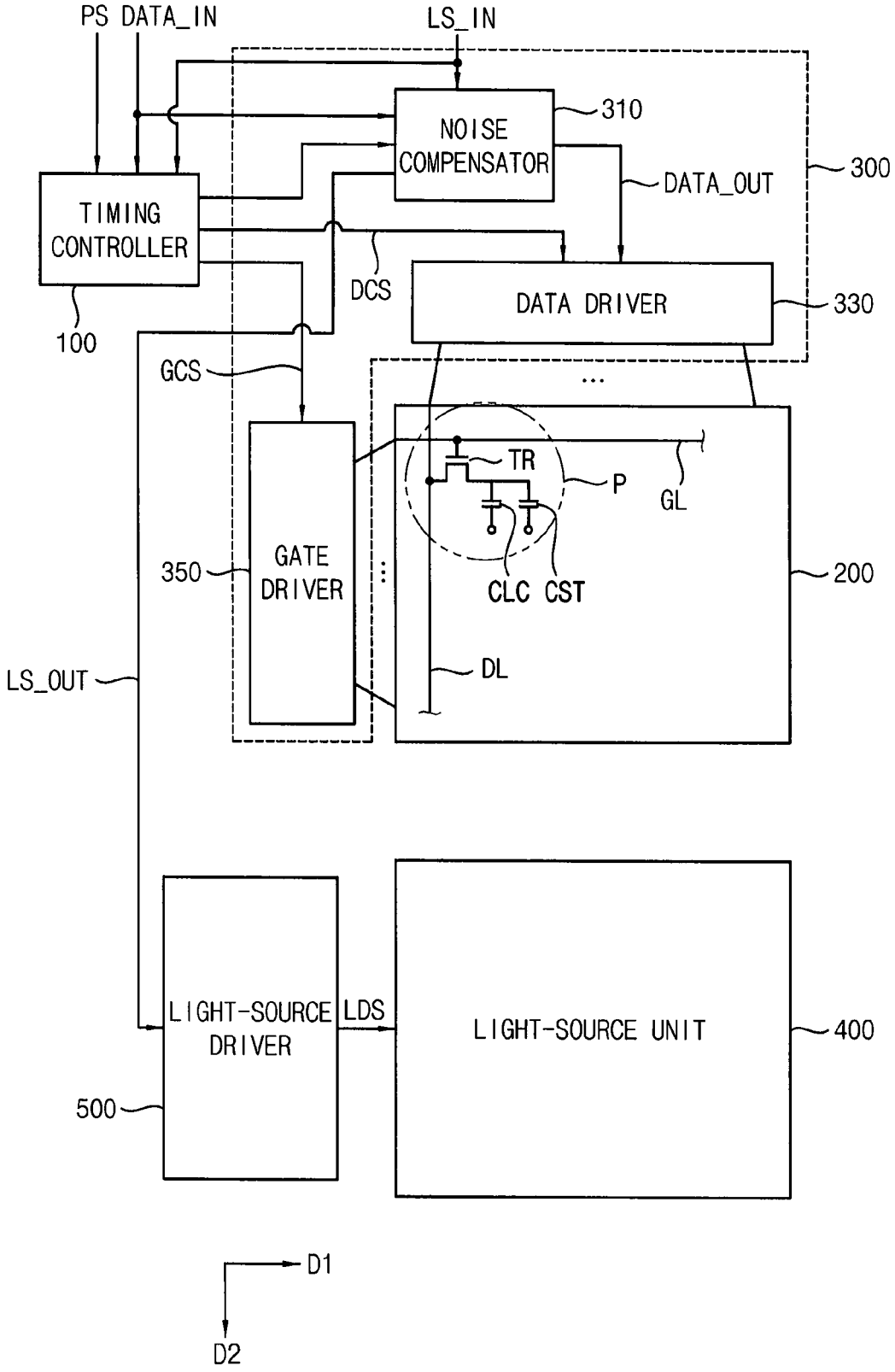
FIG. 1 is a block diagram illustrating a display apparatus according to an exemplary embodiment.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, the invention will be explained in detail with reference to the accompanying drawings.

FIG. 1 is a block diagram illustrating a display apparatus according to an exemplary embodiment.

Referring to FIG. 1, the display apparatus may include a timing controller 100, a display panel 200, a panel driver 300, a light-source unit 400 and a light-source driver 500. The panel driver 300 may include a noise compensator 310, a data driver 330 and a gate driver 350.

The timing controller 100 is configured to generally control an operation of the display apparatus. In an exemplary embodiment, the timing controller 100 is configured to receive a panel synch signal PS, a light-source synch signal LS_IN and an input data DATA_IN from an external system. The timing controller 100 is configured to generate a panel control signal for driving the display panel 200 based on the panel synch signal PS. A light-source driving signal LDS is generated to drive the light-source unit 400 based on the light-source synch signal LS_IN. In an exemplary embodiment, the input data DATA_IN may include color data such as red data, green data and blue data.

The panel synch signal PS may include a data control signal DCS for controlling the data driver 330 and a gate control signal GCS for controlling the gate driver 350 based on a frame frequency of the display panel 200 which is preset. In an exemplary embodiment, the data control signal DCS may include a vertical synch signal, a horizontal synch signal, a data enable signal, a load signal, a dot clock signal and so on, for example. In an exemplary embodiment, the gate control signal GCS may include a vertical start signal, a gate clock signal, a gate enable signal and so on, for example.

The display panel 200 may include a plurality of gate lines GL, a plurality of data lines DL and a plurality of pixels P. The gate lines GL extend in a first direction D1 and are arranged in a second direction D2 crossing the first direction D1. The data lines DL extend in the second direction D2 and are arranged in the first direction D1. The pixels P are arranged as a matrix type, and each of the pixels P may include a switching element TR which is connected to a gate line and a data line DL, a liquid crystal capacitor CLC which is connected to the switching element TR and a storage capacitor CST which is connected to liquid crystal capacitor CLC.

The noise compensator 310 is configured to output a correction data DATA_OUT to compensate the input data DATA_IN such that a luminance difference by an interference noise of the light-source synch signal LS_IN is compensated.

In an exemplary embodiment, the noise compensator 310 is configured to detect a turn-on period and a turn-off period of the light-source unit 400 based on the light-source synch signal LS_IN, for example. A compensation period during which the input data DATA_IN are corrected to compensate the interference noise of the light-source synch signal LS_IN, is determined based on the turn-on period and the turn-off period. A compensation area including at least one horizontal line corresponding to the compensation period is determined. The noise compensator 310 is configured to correct the input data DATA_IN of the compensation area based on noise compensation data and to output correction data DATA_OUT of the compensation area, during the compensation period. And then, the noise compensator 310 is configured to correct the input data DATA_IN of a normal area which includes at least one horizontal line based on normal compensation data and to output correction data DATA_OUT of the normal area, during a normal period.

In addition, the noise compensator 310 is configured to delay the light-source synch signal LS_IN by a delayed period during which the input data DATA_IN is corrected into the correction data DATA_OUT, and then to output a delayed light-source synch signal LS_OUT. Thus, the light-source unit 400 may be synchronized with the display panel 200 driven based on the correction data DATA_OUT.

The data driver 330 may be connected to end portions of the data lines DL. The data driver 330 is configured to convert the correction data DATA_OUT provided from the timing controller 100 into a data voltage, and to provide the data lines DL with the data voltage based on the data control signal DCS.

The gate driver 350 may be connected to end portions of the gate lines. The gate driver 350 is configured to generate a plurality of gate signals using the gate control signal GCS provided from the timing controller 100 and gate ON and OFF voltages provided from a voltage generator (not shown), and to sequentially provide the gate lines with the plurality of gate signals.

The light-source unit 400 is configured to provide the display panel 200 with a light. In exemplary embodiments, the light-source unit 400 has an edge-illumination type or a direct-illumination type according to a position of a light source unit generating the light. In an exemplary embodiment, the light-source unit of the direct-illumination type may include at least one light-source which is disposed under the display panel 200, for example. In an exemplary embodiment, the light-source unit of the edge-illumination type may include a light guide plate which uniformly provides the display panel 200 with the light and at least one light-source which is disposed at an edge of the light guide plate, for example. In an exemplary embodiment, the light-source unit may include at least one light-source which is individually driven with a local dimming mode, for example. In an exemplary embodiment, the light-source may be a light emitting diode ("LED"), for example.

The light-source driver 500 is configured to generate a light-source driving signal LDS to drive the light-source unit 400 based on the light-source synch signal LS_OUT and to provide the light-source unit 400 with the light-source driving signal LDS. When the light-source unit 400 includes a plurality of LEDs, the light-source driving signal LDS may be a pulse width modulation ("PWM") signal, for example.

Figure 2:
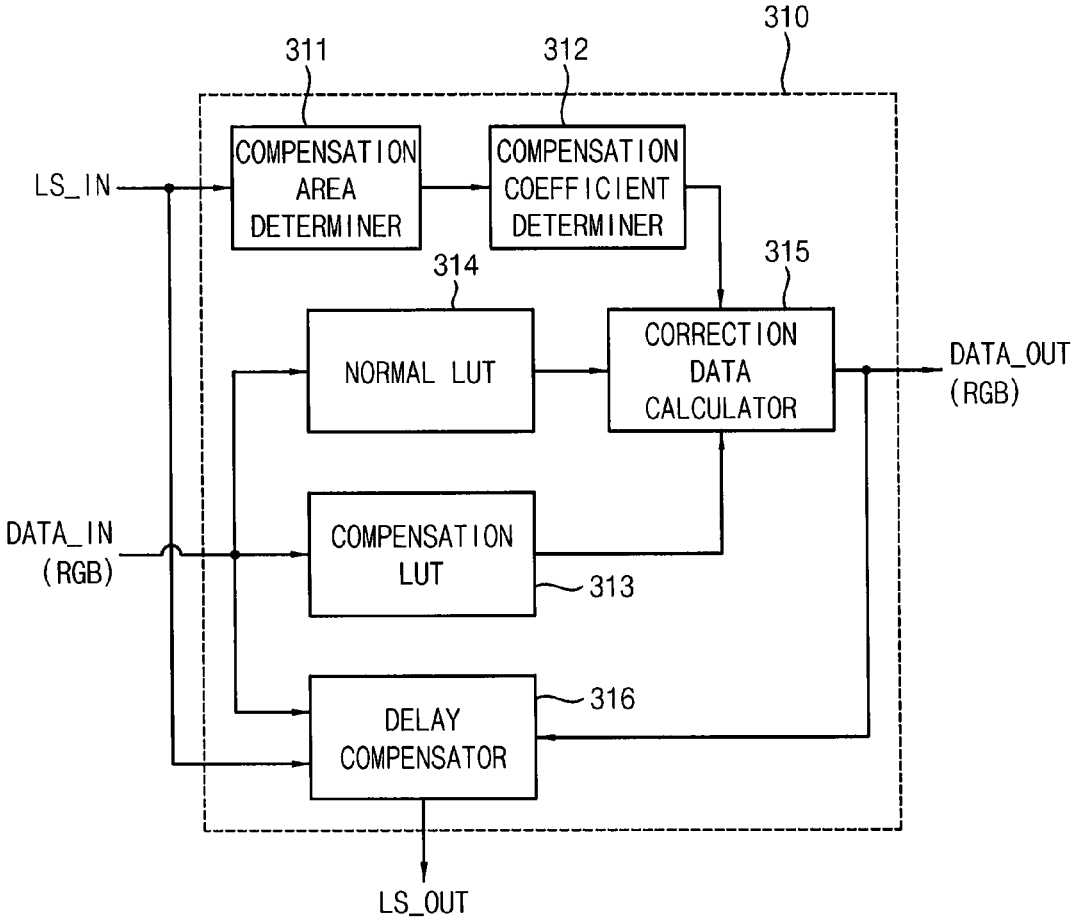
FIG. 2 is a block diagram illustrating a noise compensator of FIG. 1.

FIG. 2 is a block diagram illustrating a noise compensator of FIG. 1. FIGS. 3A and 3B are conceptual diagrams illustrating a compensation look-up-table ("LUT") and a normal LUT of FIG. 2.

Referring to FIGS. 1 and 2, the noise compensator 310 may include a compensation area determiner 311, a compensation coefficient determiner 312, a compensation LUT 313, a normal LUT 314, a correction data calculator 315 and a delay compensator 316.

The compensation area determiner 311 is configured to receive the light-source synch signal LS_IN and to detect a turn-on period and a turn-off period of the light-source unit 400 based on the light-source synch signal LS_IN. A compensation period of a frame period during which an interference noise of the light-source driving signal LDS is compensated and a normal period of the frame period which does not need to compensate the interference noise of the light-source driving signal LDS are determined based on the turn-on period and the turn-off period. The compensation area determiner 311 is configured to divide the display area of the display panel 200 into a compensation area corresponding to the compensation period and a normal area corresponding to the normal period by every frame. Each of the compensation area and the normal area may include at least one horizontal line.

The compensation coefficient determiner 312 is configured to store a plurality of compensation coefficients which is preset, and to determine a compensation coefficient corresponding to the horizontal line of the compensation area.

In an exemplary embodiment, the compensation coefficient determiner 312 is configured to determine the compensation coefficient of the input data DATA_IN corresponding to the normal area into '0', for example. When the compensation coefficient is '0', the interference noise does not need to be compensated. In an exemplary embodiment, the compensation coefficient determiner 312 is configured to determine the compensation coefficient of the input data DATA_IN corresponding to the compensation area within a range of about 0.1 to about 1.

The compensation area may be divided into a boundary area corresponding to a boundary between the compensation area and the normal area and a remaining area except for the boundary area. The compensation coefficient of the input data DATA_IN corresponding to the boundary area may be determined to gradually change. Thus, the luminance difference observed in the boundary area may be decreased or eliminated. In an exemplary embodiment, the compensation coefficient of the input data DATA_IN corresponding to the remaining area may be determined into a maximum compensation coefficient, that is '1'.

Referring to FIG. 3A, the compensation LUT 313 is configured to store a plurality of noise compensation data for compensating a display defect by the interference noise of the light-source driving signal LDS, such as a waterfall noise. The compensation LUT 313 is configured to store noise compensation data corresponding to a grayscale of the input data. In an exemplary embodiment, the compensation LUT 313 may store noise compensation data such as red, green and blue noise compensation data respectively corresponding to red, green and blue data which are the input data. Even not shown in figures, in an exemplary embodiment, the compensation LUT 313 may store a plurality of noise compensation data corresponding to a plurality of sample grayscales sampled from total grayscales and then, noise compensation data of remaining grayscales not sampled from the total grayscales may be calculated through an interpolation method, for example. In an exemplary embodiment, the noise compensation data in the compensation LUT 313 may have a high grayscale higher than the normal compensation data in the normal LUT 314 (See FIG. 3B) with respect to a same grayscale of the input data.

Referring to FIG. 3B, the normal LUT 314 is configured to store a plurality of normal compensation data for compensating full white according to a color temperature. The normal LUT 314 is configured to store normal compensation data corresponding to a grayscale of the input data. In an exemplary embodiment, the normal LUT 314 may store normal compensation data such as red, green and blue normal compensation data respectively corresponding to red, green and blue data which are the input data. Even not shown in figures, in an exemplary embodiment, the normal LUT 314 may store a plurality of noise compensation data corresponding to a plurality of sample grayscales sampled from total grayscales and then, noise compensation data of remaining grayscales not sampled from the total grayscales may be calculated through the interpolation method, for example.

The correction data calculator 315 is configured to finally calculate noise compensation data DATA_OUT using the compensation coefficient determined according to a position of the input data DATA_IN and the noise compensation data determined according to the grayscale of the input data DATA_IN.

The correction data calculator 315 is configured to calculate the noise compensation data DATA_OUT as following Expression 1.

$$R_{out}=VB\times R_{compensation}+(1-VB)\times R_{input}$$

$$G_{out}=VB\times G_{compensation}+(1-VB)\times G_{input}$$

$$B_{out}=VB\times B_{compensation}+(1-VB)\times B_{input} \qquad \text{Expression 1}$$

Referring to Expression 1, Rinput, Ginput and Binput are the input data DATA_IN, VB is the compensation coefficient corresponding to the position of the input data DATA_IN, and Rcompensatation, Gcompensatation and Bcompensation are the noise compensation data obtained from the compensation LUT 313.

Referring back to FIGS. 1 and 2, the delay compensator 316 is configured to calculate a delay period which is a difference period between an input timing of the input data DATA_IN and an output timing of the correction data DATA_OUT. The delay compensator 316 is configured to delay the light-source synch signal LS_IN and to output the delayed light-source synch signal LS_OUT. The delay compensator 316 is configured to provide the light-source driver 500 with the light-source synch signal LS_OUT. Thus, the light-source unit 400 drives in synchronization with the display panel 200.

Figure 4A:
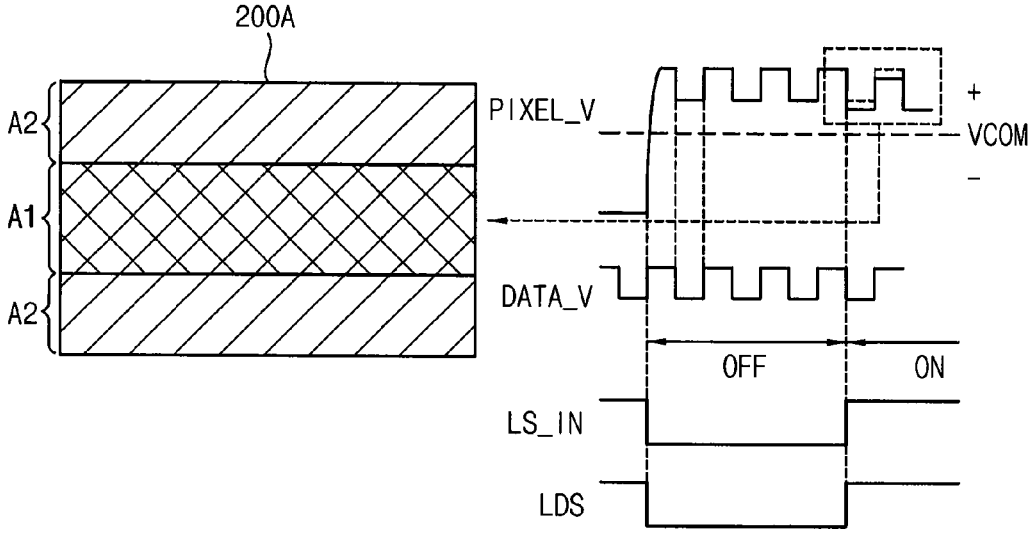
FIG. 4A is a conceptual diagram illustrating a comparative exemplary embodiment of a method of driving a display apparatus according to the invention.
Figure 4B:
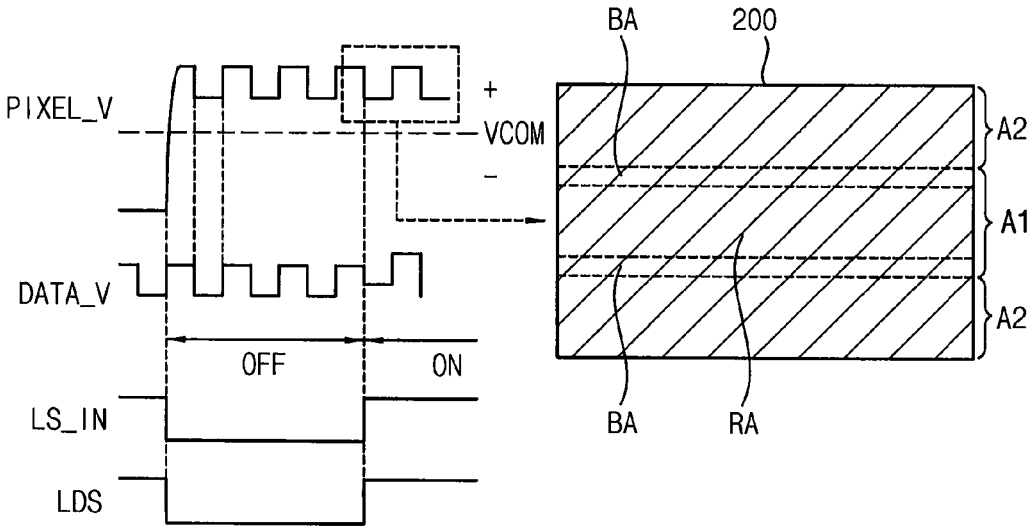
FIG. 4B is a conceptual diagram illustrating to an exemplary embodiment of a method of driving a display apparatus according to the invention.

FIG. 4A is a conceptual diagram illustrating a method of driving a display apparatus according to a comparative exemplary embodiment. FIG. 4B is a conceptual diagram illustrating a method of driving a display apparatus according to an exemplary embodiment.

Referring to FIG. 4A, according to the comparative exemplary embodiment, a data voltage DATA_V applied to a display panel 200A is based on a frame frequency, and a light-source driving signal LDS applied to the light-source unit is based on a light-source driving frequency. The light-source driving signal LDS is synchronized with the light-source synch signal LS_IN.

The data voltage DATA_V is applied to the display panel 200A.

The light-source driving signal LDS is applied to the light-source unit which provide the display panel 200A with the light.

As shown FIG. 4A, an image displayed on the display panel 200A includes the waterfall noise in a first area A1 corresponding to a turn-on period ON of the light-source driving signal LDS having a high level or in a second area A2 corresponding to a turn-off period OFF of the light-source driving signal LDS having a low level by an interference noise of the light-source driving signal LDS. A pixel voltage PIXEL_V of a positive polarity (+) charged in the pixel is shifted toward a common voltage level VCOM by the interference noise of the light-source driving signal LDS during the turn-on period, for example, and thus luminance of the first area A1 corresponding to a turn-on period ON may be decreased.

When the display panel 200A is driven with a normally black mode, the first area A1 which is a compensation area corresponding to the turn-on period ON of the light-source driving signal LDS displays an image of luminance lower than an image displayed on the second area A2 which is a normal area.

As described above, the pixel voltage PIXEL_V charged in the display panel 200A increases or decreases by the interference noise of the light-source driving signal LDS, and thus a luminance difference such as the waterfall noise occurs.

Referring to FIGS. 2 and 4B, according to the exemplary embodiment, a data voltage DATA_V applied to a display panel 200 is based on a frame frequency and a light-source driving signal LDS applied to the light-source unit 400 is based on a light-source driving frequency. The light-source driving signal LDS is synchronized with the light-source synch signal LS_IN.

The data voltage DATA_V is applied to the display panel 200.

The light-source driving signal LDS is applied to the light-source unit 400 which provide the display panel 200 with the light.

The compensation area determiner 311 is configured to receive the light-source synch signal LS_IN, and to detect a turn-on period and a turn-off period of the light-source unit 400 based on the light-source synch signal LS_IN. A compensation period of a frame period during which an interference noise of the light-source driving signal LDS is compensated and a normal period of the frame period which does not need to compensate the interference noise of the light-source driving signal LDS are determined based on the turn-on period and the turn-off period.

In an exemplary embodiment, as shown in FIG. 4B, the compensation area determiner 311 is configured to divide the display area of the display panel 200 into a compensation area A1 corresponding to the compensation period and a normal area A2 corresponding to the normal period, for example. The compensation coefficient determiner 312 is configured to determine a compensation coefficient of the input data corresponding to the compensation area A1 and a compensation coefficient of the input data corresponding to the normal area A2.

The compensation area A1 is divided into a boundary area BA corresponding to a boundary between the compensation area A1 and the normal area A2 and a remaining area RA except for the boundary area BA.

The compensation coefficient of the input data DATA_IN corresponding to the boundary area BA may be determined to gradually change. Thus, the luminance difference observed in the boundary area BA may be decreased or eliminated. In an exemplary embodiment, the compensation coefficient of the input data DATA_IN corresponding to the remaining area RA may be determined into a maximum compensation coefficient, that is '1', for example. When the compensation coefficient is '1', the noise compensation data of the compensation LUT 313 are used.

However, the compensation coefficient corresponding to the input data of the normal area A2 is determined into '0'. When the compensation coefficient is '0', the compensation LUT 313 is not used and the normal LUT 314 is used.

Therefore, the correction data calculator 315 is configured to calculate correction data for the compensation area A1 using the noise compensation data of the compensation LUT 313 and to calculate correction data for the normal area A2 using the normal compensation data of the normal LUT 314.

In an exemplary embodiment, the noise compensation data may be a high grayscale higher than a grayscale of the normal compensation data with respect to the input data of a same grayscale, for example. However, the invention is not limited thereto, and the noise compensation data may be a low grayscale lower than a grayscale of the normal compensation data with respect to the input data having a same grayscale according to a driving mode of the display panel and light-source unit.

As shown in FIG. 4B, corrected data voltage having a high grayscale higher than a grayscale of the input data is applied to the pixel in the compensation area A1. The compensation area A1 displays an image of a target luminance by the corrected data voltage having the high grayscale even when the pixel voltage PIXEL_V in the compensation area A1 is decreased by the interference noise of the light-source driving signal LDS.

Thus, a luminance difference such as the waterfall noise which occurs by changing the pixel voltage PIXEL_V charged in the display panel 200 by the interference noise of the light-source driving signal LDS, may be decreased or eliminated.

Figure 5:
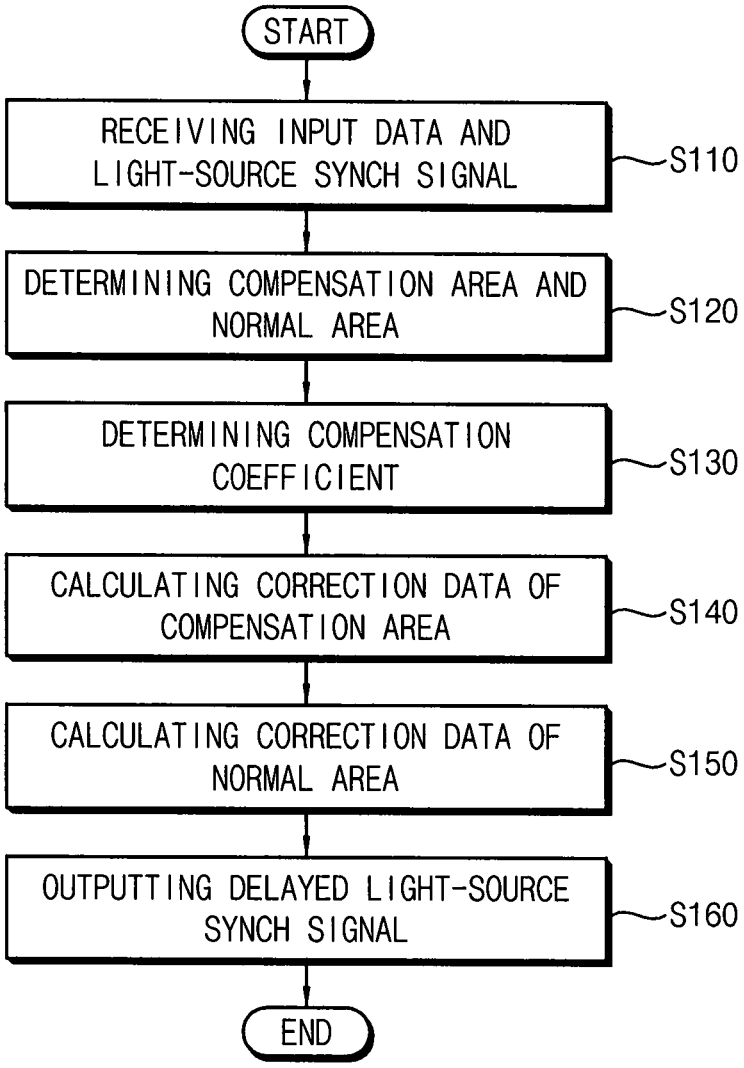
FIG. 5 is a flowchart illustrating an exemplary embodiment of a method of driving a display apparatus according to the invention.

FIG. 5 is a flowchart illustrating a method of driving a display apparatus according to an exemplary embodiment.

Referring to FIGS. 2, 4B and 5, the noise compensator 310 is configured to receive input data DATA_IN and a light-source synch signal LS_IN (operation S110). The input data DATA_IN is received in synchronization with synch signals such as a vertical synch signal and a horizontal synch signal based on a frame frequency. The light-source synch signal LS_IN has a light-source driving frequency.

The compensation area determiner 311 is configured to detect a turn-on period and a turn-off period of the light-source unit 400 based on the light-source synch signal LS_IN. A compensation period of a frame period during which an interference noise of the light-source driving signal LDS is compensated and a normal period of the frame period which does not need to compensate the interference noise of the light-source driving signal LDS are determined based on the turn-on period and the turn-off period.

The compensation area determiner 311 is configured to divide the display area of the display panel 200 into a compensation area corresponding to the compensation period and a normal area corresponding to the normal period (operation S120). Each of the compensation area and the normal area may include at least one horizontal line.

The compensation area determiner 311 is configured to respectively determine compensation coefficients corresponding to the input data DATA_IN of the compensation area and the normal area.

The compensation area may be divided into a boundary area BA corresponding to a boundary between the compensation area and the normal area and a remaining area RA except for the boundary area BA. Thus, the luminance difference observed in the boundary area BA may be decreased or eliminated. In an exemplary embodiment, the compensation coefficient of the input data DATA_IN corresponding to the remaining area RA may be determined into a maximum compensation coefficient, that is '1' (operation S130), for example.

The correction data calculator 315 is configured to apply the compensation coefficient to the noise compensation data obtained from the compensation LUT 313 corresponding to the input data DATA_IN of the pixel located in the compensation area and to calculate correction data DATA_OUT of the compensation area (operation S140).

The correction data calculator 315 is configured to calculate correction data of the normal area DATA_OUT based on the normal compensation data obtained from the normal LUT 314 corresponding to the input data DATA_IN of the pixel located the normal area (operation S150).

The delay compensator 316 is configured to calculate a delay period which is a difference period between an input timing of the input data DATA_IN and an output timing of the correction data DATA_OUT. The delay compensator 316 is configured to delay the light-source synch signal LS_IN and to output the delayed light-source synch signal LS_OUT (operation S160).

The delay compensator 316 is configured to provide the light-source driver 500 with the light-source synch signal LS_OUT. Thus, the light-source unit 400 may drive in synchronization with the display panel 200.

Figure 6:
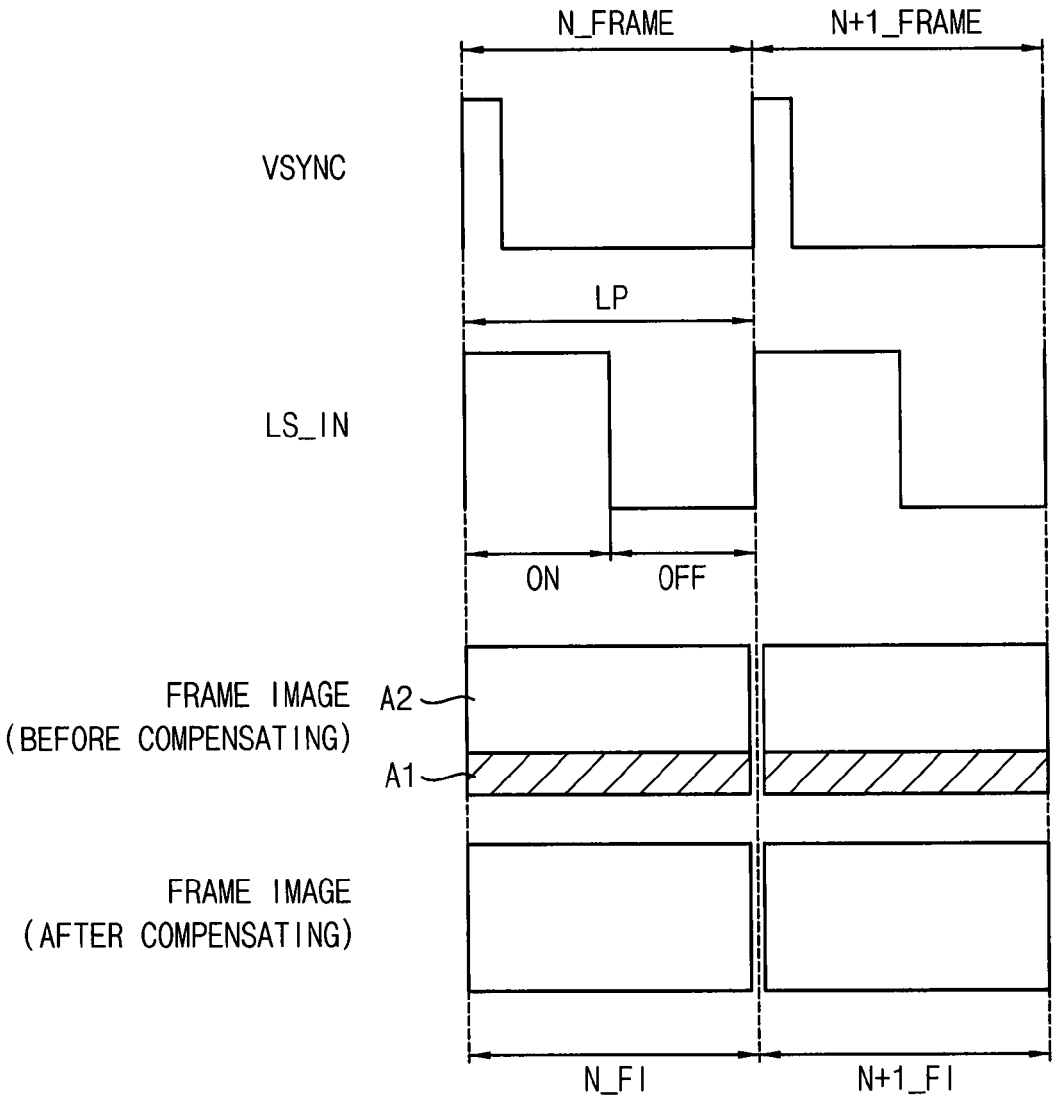
FIG. 6 is a diagram illustrating an exemplary embodiment of a method of driving a display apparatus according to the invention.

FIG. 6 is a diagram illustrating a method of driving a display apparatus according to an exemplary embodiment.

Referring to FIGS. 2 and 6, the noise compensator 310 is configured to receive input data DATA_IN based on a vertical synch signal VSYNC having a frame frequency and a light-source synch signal LS_IN having a light-source driving frequency. According to the exemplary embodiment, the light-source driving frequency may be one times the frame frequency. Thus, a period LP of the light-source synch signal LS_IN is equal to a frame period.

In an exemplary embodiment, during an N-th frame N_FRAME, the noise compensator 310 is configured to receive the light-source synch signal LS_IN, for example.

The compensation area determiner 311 is configured to detect a turn-on period ON and a turn-off period OFF of the light-source unit based on the light-source synch signal LS_IN. A compensation period of a frame period during which an interference noise of the light-source driving signal LDS is compensated and a normal period of the frame period which does not need to compensate the interference noise of the light-source driving signal LDS are determined based on the turn-on period ON and the turn-off period OFF. In an exemplary embodiment, the compensation period may be the turn-on period ON and the normal period may be the turn-off period OFF.

The compensation area determiner 311 is configured to divide the display area of the display panel 200 into a compensation area A1 corresponding to the compensation period and a normal area A2 corresponding to the normal period.

The compensation area determiner 311 is configured to determine a compensation coefficient of the input data corresponding to the compensation area A1 and a compensation coefficient of the input data corresponding to the normal area A2. The compensation coefficient of the input data DATA_IN corresponding to the boundary area BA between the compensation area A1 and the normal area A2 may be determined to gradually change.

The correction data calculator 315 is configured to apply the compensation coefficient to the noise compensation data obtained from the compensation LUT 313 corresponding to the input data DATA_IN of the pixel located in the compensation area A1 and to calculate correction data DATA_OUT of the compensation area A1. The correction data calculator 315 is configured to calculate correction data DATA_OUT of the normal area A2 based on the normal compensation data obtained from the normal LUT 314 corresponding to the input data DATA_IN of the pixel located in the normal area A2.

The display panel displays an N-th frame image N_FI based on the correction data of the N-th frame N_FRAME. Thus, a luminance difference such as the waterfall noise by the interference noise of the light-source driving signal LDS may be decreased or eliminated.

Then, during an (N+1)-th frame N+1_FRAME, the noise compensator 310 is configured to receive the light-source synch signal LS_IN.

When the frame frequency is equal to the light-source driving frequency, the compensation area A1 in which the luminance difference occurs by the interference noise of the light-source driving frequency, is fixed in every frame period.

Thus, the compensation area determiner 311 is configured to determine a compensation area A1 and a normal area A2 of the (N+1)-th frame N+1_FRAME to be equal to those of the N-th frame N_FRAME.

The compensation area determiner 311 is configured to determine a compensation coefficient of the input data corresponding to the compensation area A1 and a compensation coefficient of the input data corresponding to the normal area A2.

The correction data calculator 315 is configured to apply the compensation coefficient to the noise compensation data obtained from the compensation LUT 313 corresponding to the input data DATA_IN of the pixel located in the compensation area A1 and to calculate correction data DATA_OUT of the compensation area. The correction data calculator 315 is configured to calculate correction data of the normal area DATA_OUT based on the normal compensation data obtained from the normal LUT 314 corresponding to the input data DATA_IN of the pixel located the normal area A2.

The display panel displays an (N+1)-th frame image N+1_FI based on the correction data of the (N+1)-th frame N+1_FRAME. Thus, a luminance difference such as the waterfall noise by the interference noise of the light-source driving signal LDS may be decreased or eliminated.

As described above, the input data of the compensation area in which the pixel charge voltage is changed by the interference noise of the light-source driving frequency, are compensated, and thus the luminance difference may be decreased or eliminated.

Figure 7:
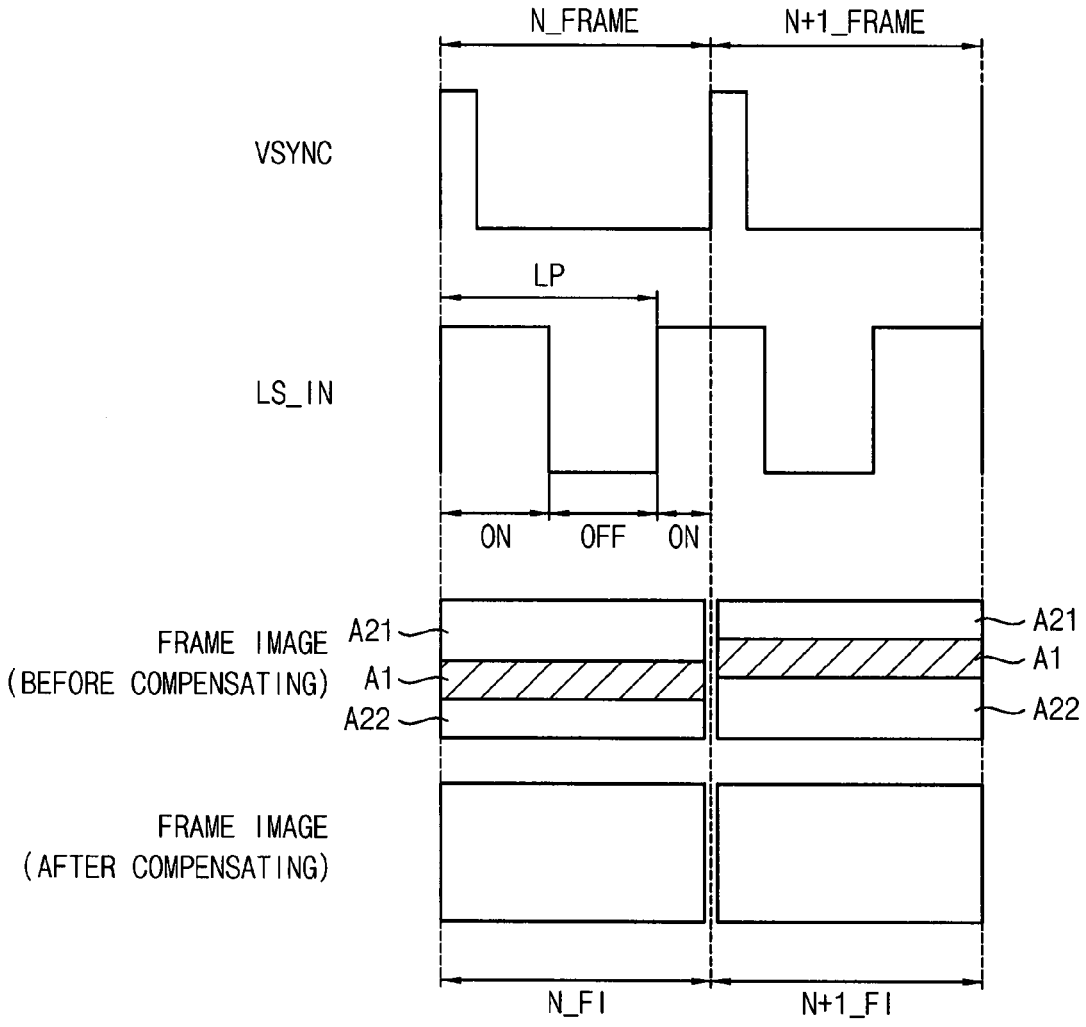
FIG. 7 is a diagram illustrating an exemplary embodiment of a method of driving a display apparatus according to the invention.

FIG. 7 is a diagram illustrating a method of driving a display apparatus according to an exemplary embodiment.

Referring to FIGS. 2 and 7, the noise compensator 310 is configured to receive input data DATA_IN based on a vertical synch signal VSYNC having a frame frequency and a light-source synch signal LS_IN having a light-source driving frequency. According to the exemplary embodiment, the light-source driving frequency may be about 1.25 multiplied by the frame frequency. Thus, the frame period is about 1.25 times a period of the light-source synch signal LS_IN.

In an exemplary embodiment, during an N-th frame N_FRAME, the noise compensator 310 is configured to receive the light-source synch signal LS_IN, for example.

The compensation area determiner 311 is configured to detect the turn-on period ON and the turn-off period OFF of the light-source unit based on the light-source synch signal LS_IN. A compensation period of a frame period during which an interference noise of the light-source driving signal LDS is compensated and a normal period of the frame period which does not need to compensate the interference noise of the light-source driving signal LDS are determined based on the turn-on period ON and the turn-off period OFF. In an exemplary embodiment, the compensation period may be the turn-on period ON and the normal period may be the turn-off period OFF.

The compensation area determiner 311 is configured to divide the display area of the display panel into a compensation area A1 corresponding to the compensation period and a normal area A2 corresponding to the normal period.

According to the exemplary embodiment, the frame frequency is different from the light-source driving frequency, and thus the display panel may be divided into a compensation area A1, a first normal area A21 and a second normal area A22.

The compensation area determiner 311 is configured to determine a compensation coefficient of the input data corresponding to the compensation area A1 and a compensation coefficient of the input data corresponding to the first and second normal areas A21 and A22. The compensation coefficient of the input data DATA_IN corresponding to boundary areas between the compensation area A1 and the first normal area A21 and between the compensation area A1 and the second normal area A22 may be determined to gradually change.

The correction data calculator 315 is configured to apply the compensation coefficient to the noise compensation data obtained from the compensation LUT 313 corresponding to the input data DATA_IN of the pixel located in the compensation area A1 and to calculate correction data DATA_OUT of the compensation area A1. The correction data calculator 315 is configured to calculate correction data of the first and second normal areas A21 and A22 DATA_OUT based on the normal compensation data obtained from the normal LUT 314 corresponding to the input data DATA_IN of the pixel located in the first and second normal areas A21 and A22.

The display panel displays an N-th frame image N_FI based on the correction data of the N-th frame N_FRAME. Thus, a luminance difference such as the waterfall noise by the interference noise of the light-source driving signal LDS may be decreased or eliminated.

Then, during an (N+1)-th frame N+1_FRAME, the noise compensator 310 is configured to receive the light-source synch signal LS_IN.

The frame frequency is different from the light-source driving frequency, and thus the compensation area A1 in which the luminance difference occurs by the interference noise of the light-source driving frequency may be different by every frame period.

The compensation area determiner 311 is configured to detect a turn-on period ON and a turn-off period OFF of the light-source unit based on the light-source synch signal LS_IN and to divide the display area of the display panel 200 into a compensation area corresponding to the compensation period and a normal area corresponding to the normal period.

According to the exemplary embodiment, the frame frequency is different form the light-source driving frequency, and thus the display panel may be divided into a compensation area A1, a first normal area A21 and a second normal area A22. The compensation area A1, first normal area A21 and second normal area A22 are determined to be different from those of the N-th frame N_FRAME.

The compensation area determiner 311 is configured to determine a compensation coefficient of the input data corresponding to the compensation area A1 and a compensation coefficient of the input data corresponding to the first and second normal areas A21 and A22. The compensation coefficient of the input data DATA_IN corresponding to boundary areas between the compensation area A1 and the first normal area A21 and between the compensation area A1 and the second normal area A22 may be determined to gradually change.

The correction data calculator 315 is configured to apply the compensation coefficient to the noise compensation data obtained from the compensation LUT 313 corresponding to the input data DATA_IN of the pixel located in the compensation area A1 and to calculate correction data DATA_OUT of the compensation area A1. The correction data calculator 315 is configured to calculate correction data DATA_OUT of the first and second normal areas A21 and A22 based on the normal compensation data obtained from the normal LUT 314 corresponding to the input data DATA_IN of the pixel located in the first and second normal areas A21 and A22.

The display panel displays an (N+1)-th frame image N+1_FI based on the correction data of the (N+1)-th frame N+1_FRAME. Thus, a luminance difference such as the waterfall noise by the interference noise of the light-source driving signal LDS may be decreased or eliminated.

As described above, according to exemplary embodiments, the input data of the compensation area in which the pixel charge voltage is changed by the interference noise of the light-source driving frequency are compensated, and thus the luminance difference may be decreased or eliminated.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a display panel which displays an image;

a light source driver configured to provide a light source unit with a light-source driving signal, the light-source driving signal comprising a turn-on period in which the light source unit turns on the light and a turn-off period in which the light source unit turns off the light;

a compensation area determiner which divides a display area of the display panel into a compensation area corresponding to the turn-off period and a normal area corresponding to the turn-on period;

a compensation coefficient determiner which determines a compensation coefficient corresponding to input data of the compensation area;

a compensation look up table which stores a noise compensation data which compensates a luminance difference of the compensation area by an interference noise of the light-source driving signal; and a correction data calculator which calculates a correction data corresponding to the input data of the compensation area using the compensation coefficient and the noise compensation data.

2. The display apparatus of claim 1, wherein the compensation area is divided into a boundary area adjacent to a boundary between the compensation area and the normal area and a remaining area except for the boundary area, and the compensation coefficient determiner determines a compensation coefficient of the boundary area to gradually increase by a horizontal line.

3. The display apparatus of claim 1, further comprising:

a normal look up table which stores a normal compensation data which compensates input data of the normal area.

4. The display apparatus of claim 3, wherein the noise compensation data of the compensation look up table have a grayscale higher than the normal compensation data of the normal look up table with respect to the input data having a same grayscale.

5. The display apparatus of claim 3, wherein each of the compensation look up table and the normal look up table comprises red compensation data, green compensation data and blue compensation data respectively corresponding to red, green, and blue input data.

6. The display apparatus of claim 3, wherein the compensation area determiner determines the compensation area and the normal area based on a high level and a low level of the light-source driving signal.

7. The display apparatus of claim 6, wherein when a light-source driving frequency of a light-source synch signal is equal to a frame frequency driving the display panel, the compensation area and the normal area are identically determined by a frame, and when the light-source driving frequency is different from the frame frequency, the compensation area and the normal area are differently determined by the frame.

8. The display apparatus of claim 1, further comprising:

a delay compensator which delays a light-source synch signal based on an input timing of the input data and an output timing of the correction data.

9. The display apparatus of claim 8, further comprising:

a light-source unit comprising at least one light-source which provides the display panel with a light; and a light-source driver which outputs the light-source driving signal which drives the light-source unit based on the light-source synch signal.

10. The display apparatus of claim 9, wherein the at least one light-source includes a light-emitting diode, and the light-source driving signal is a pulse width modulation signal.

11. A method of driving a display apparatus, the method comprising:

generating a light source driving signal comprising a turn-on period in which a light source unit turns on a light and a turn-off period in which the light source unit turns off the light;

dividing a display area of a display panel into a compensation area corresponding to the turn-off period and a normal area corresponding to the turn-on period;

determining a compensation coefficient corresponding to input data of the compensation area; and calculating a correction data corresponding to the input data of the compensation area using the compensation coefficient and noise compensation data, the noise compensation data compensating a luminance difference of the compensation area by an interference noise of the light-source driving signal.

12. The method of claim 11, wherein the compensation area is divided into a boundary area adjacent to a boundary between the compensation area and the normal area and a remaining area except for the boundary area, and a compensation coefficient of the boundary area is determined to gradually increase by a horizontal line.

13. The method of claim 11, further comprising:

compensating input data of the normal area using normal compensation data.

14. The method of claim 13, wherein the noise compensation data have a grayscale higher than the normal compensation data with respect to the input data having a same grayscale.

15. The method of claim 13, wherein each of the noise compensation data and the normal compensation data comprises red compensation data, green compensation data and blue compensation data respectively corresponding to red, green, and blue input data.

16. The method of claim 11, wherein the compensation area and the normal area are determined based on a high level and a low level of the light-source driving signal.

17. The method of claim 16, wherein when a light-source driving frequency of a light-source synch signal is equal to a frame frequency driving the display panel, the compensation area and the normal area are identically determined by a frame, and when the light-source driving frequency is different from the frame frequency, the compensation area and the normal area are differently determined by the frame.

18. The method of claim 11, further comprising:

delaying a light-source synch signal based on an input timing of the input data and an output timing of the correction data.

19. The method of claim 18, further comprising:

driving a light-source which provides the display panel with a light based on the delayed light-source driving signal.

20. The method of claim 19, wherein the light-source includes a light-emitting diode, and the light-source driving signal is a pulse width modulation signal.

* * * * *